US008182361B2

(12) United States Patent
Gill

(10) Patent No.: US 8,182,361 B2
(45) Date of Patent: May 22, 2012

(54) CHANGEABLE GRIP

(75) Inventor: David Keith Gill, Pinehurst, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/795,729

(22) Filed: Jun. 8, 2010

(65) Prior Publication Data

US 2011/0300965 A1 Dec. 8, 2011

(51) Int. Cl.
*A63B 53/16* (2006.01)

(52) U.S. Cl. ..... 473/299; 473/300; 473/549; 473/568; 81/489

(58) Field of Classification Search ..... 473/294–299, 473/300–303, 549–552, 568; 280/821; 74/551.9; 81/489–492; 16/421–422, 426–427, 429–430, 16/DIG. 12, DIG. 18, DIG. 19, DIG. 24
See application file for complete search history.

(56) References Cited

U.S. PATENT DOCUMENTS

| | | | | | |
|---|---|---|---|---|---|
| 153,112 | A * | 7/1874 | Race | 74/553 |
| 1,626,967 | A | 5/1927 | Reach | |
| 1,967,355 | A * | 7/1934 | Edwards | 473/295 |
| 2,103,889 | A | 12/1937 | Brisick | |
| 2,347,789 | A * | 5/1944 | Nichols | 280/821 |
| 2,871,899 | A | 4/1958 | Coyle et al. | |
| 3,360,264 | A * | 12/1967 | Lamkin et al. | 473/298 |
| 4,004,818 | A * | 1/1977 | Ramillon | 280/821 |
| 4,244,602 | A * | 1/1981 | Allsop et al. | 280/821 |
| 4,893,519 | A * | 1/1990 | Corso et al. | 74/551.9 |
| 5,299,802 | A * | 4/1994 | Bouchet-Lassale | 473/206 |
| 5,575,724 | A | 11/1996 | Hannon et al. | |
| 5,713,104 | A | 2/1998 | Giampaolo | |
| 5,730,662 | A | 3/1998 | Rens | |
| 5,906,548 | A | 5/1999 | Hadge | |
| 6,254,501 | B1 * | 7/2001 | Chang | 473/545 |
| 6,511,386 | B1 | 1/2003 | Cacicedo | |
| 6,718,675 | B1 * | 4/2004 | Lu | 40/661.12 |
| 6,746,336 | B1 * | 6/2004 | Brant et al. | 473/44 |
| 7,435,186 | B1 | 10/2008 | Miller | |
| 7,634,839 | B2 * | 12/2009 | Blauer et al. | 16/431 |
| 7,798,911 | B2 * | 9/2010 | Gill | 473/297 |
| 7,877,843 | B2 * | 2/2011 | Holland-Letz | 16/436 |
| 7,992,258 | B1 * | 8/2011 | Stitser | 16/430 |
| 2002/0107088 | A1 | 8/2002 | Lamkin et al. | |

(Continued)

FOREIGN PATENT DOCUMENTS

EP 1 927 439 4/2008

(Continued)

OTHER PUBLICATIONS

European Search Report dated Sep. 27, 2011, for European Patent Application No. 11004677.8-2318.

*Primary Examiner* — Stephen L. Blau
(74) *Attorney, Agent, or Firm* — Daniel S. Kalka

(57) ABSTRACT

A changeable grip 12 for a shock imparting implement has a gripping sleeve 18 positioned on a handle sleeve 15 attached to a handle 14. A lower end of gripping sleeve 18 abuts a ledge 28 integrally formed in the handle sleeve 15. A threaded cap 20 compresses the gripping sleeve 18 against the ledge 28 to secure the grip 12 to the handle sleeve 15. Optional splines 40 on an outer surface of the handle sleeve 15 meshing with channels 42 in the gripping sleeve 18 function to prevent slippage or rotation during use.

16 Claims, 4 Drawing Sheets

U.S. PATENT DOCUMENTS

| | | | | |
|---|---|---|---|---|
| 2006/0094525 | A1 | 5/2006 | Hung | |
| 2006/0163865 | A1* | 7/2006 | Smith et al. | 280/821 |
| 2006/0287124 | A1 | 12/2006 | Han et al. | |
| 2007/0074374 | A1 | 4/2007 | Chien-Hung | |
| 2008/0313859 | A1 | 12/2008 | Chen | |
| 2009/0124408 | A1 | 5/2009 | Schroeder | |
| 2009/0253530 | A1 | 10/2009 | Sugimae | |
| 2010/0248858 | A1 | 9/2010 | Lu | |
| 2010/0287735 | A1* | 11/2010 | Gill et al. | 16/421 |
| 2011/0005790 | A1* | 1/2011 | Frank et al. | 173/162.2 |
| 2011/0053704 | A1* | 3/2011 | Huang | 473/300 |
| 2011/0165957 | A1* | 7/2011 | Lu | 473/298 |

FOREIGN PATENT DOCUMENTS

| | | |
|---|---|---|
| EP | 1 894 681 | 5/2008 |
| EP | 1 923 194 | 5/2008 |
| GB | 2 260 499 | 4/1993 |
| WO | WO2007/016617 | 8/2007 |
| WO | WO 2008/110888 | 9/2008 |

* cited by examiner

CHANGEABLE GRIP

FIELD

The present disclosure relates in general to a changeable grip particularly suited for shock imparting implements, and more particularly to a new and improved changeable grip for a golf club.

BACKGROUND

There are many forms of grips available on the market today for a wide variety of implements. These implements can range from hammer handles or other hand tools to sports implements like tennis, squash, or racquetball rackets, or golf clubs. While the present disclosure is particularly suited for a golf club shaft with a changeable grip and described with particular reference thereto, it should be immediately apparent that the present disclosure is not intended to be limited only to golf and extends to any sports grip or hand grip for a shock imparting implement.

Originally, golf club grips consisted primarily of a leather wrap around a handle. Later, molded rubber slip-on grips became available and are still in wide use today. A recent variation on the molded rubber grip is the concept of using a rubber sleeve or underlisting on the handle with a leather or synthetic leather wrap spirally wrapped around the underlisting, or alternatively a single panel cover over the underlisting. Grips are made today from a wide variety in construction and combinations of materials.

As the market demands a wider range of grips with different colors, weights, and sizes, producing a cost effective grip that meets a wide range of customer requirements is becoming very difficult. There still exists a need for an improved changeable grip that imparts or receives shock or force to or from a shock imparting implement. A changeable grip provides greater flexibility in selecting a specific grip for a given application or for use under a wide variety of conditions. It allows the user to select exactly the type of grip needed under the given conditions for the desired application. It is also desirable for the grip to be constructed in a manner that provides a firm grasp with little or no slippage and with good resistance to torque as well as exhibiting good shock absorbing qualities.

A changeable grip further allows for a wide variety of enhancing features to the grip such as designing the grip weight for swing weight control, or even still multiple types of gripping surfaces with interchangeable gripping sleeves of combinations of various materials. Swing weight control, handle stiffness, flex control, shock absorption are just some of the important factors in improving the impact from the implement. The concept of tailoring a grip to provide the user with multiple options minimizes the need for multiple grips and multiple implements.

Thus, it is desirable to have a changeable grip that allows the user to select the right fit and feel for the handle or shaft of a shock imparting implement or tool to meet the needs of the user in a given application.

BRIEF SUMMARY OF THE DISCLOSURE

The present disclosure describes a changeable grip for a shock imparting implement that offers a wide variety of features.

The changeable grip according to the present disclosure is mounted on a handle sleeve fixedly attached to the handle of a shock imparting implement. The handle sleeve comprises an initial diameter sized to slide onto a handle of a shock imparting implement and be attached thereto. A first end of the handle sleeve at a selected distance has a diameter larger than the initial diameter and includes a bend to form a ledge. The second end terminates in a butt end with a threaded indentation. The gripping sleeve slides on the handle sleeve where a lower end of the gripping sleeve abuts the ledge. A cap with a threaded fastener meshes with the threaded indentation in the butt end of the handle sleeve to compress the gripping sleeve up against the ledge.

The changeable grip is particularly suited for use as a changeable golf club grip. The design of the present disclosure accommodates the U.S. Golf Association ("USGA") rules requirement for the shaft to extend the full length of the shaft as well as provides a structure that has a simple configuration with reduced parts.

The various features of novelty which characterize the present disclosure are pointed out with particularity in the claims annexed to and forming a part of this disclosure. For a better understanding of the present disclosure and its operating advantages attained with its use, reference is made to the accompanying drawings, and descriptive matter.

DETAILED DESCRIPTION OF THE DISCLOSURE

Figure 1:
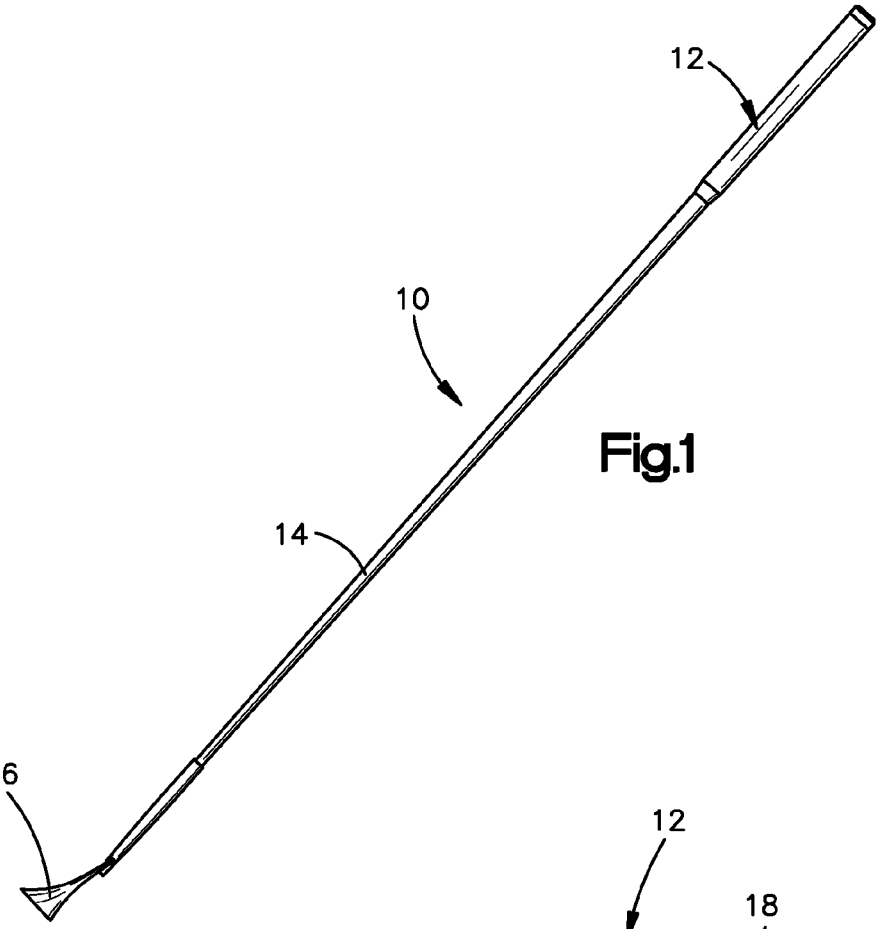
FIG. 1 is an elevated perspective view of a golf club.

Referring to the figures, which are not intended to limit the present disclosure, and where like numerals designate like or similar features throughout the several views, and first in particular to FIG. 1, there is shown a golf club generally designated 10. Golf club 10 includes a golf club grip 12, a shaft or handle 14, and a club head 16. A golf club is but one example of a shock imparting implement that the changeable grip of the present disclosure finds utility. There are many other examples of shock imparting implements known in the art. The term "shock imparting implement" as used herein is meant to include sporting implements and tools that are used to strike, impart, or apply a force to an object or an implement, or conversely receive an impact or force from the implement. Tennis racquets, squash racquets, racquetball racquets, lacrosse grips, fishing rod handles, bicycle handles, motorcycle handles, gear shift levers, and baseball grips are but only a few examples meant to be included in the term "shock imparting implements". Naturally there are many others, and even possibly more sport items that may still be developed. While particular reference is being made to a golf club handle with a changeable grip in the subject disclosure, it should be understood that the subject disclosure is applicable to any shock imparting implement including but not limited to other sporting implements and tool handles such as a hammer handle or a screwdriver handle.

Figure 2:
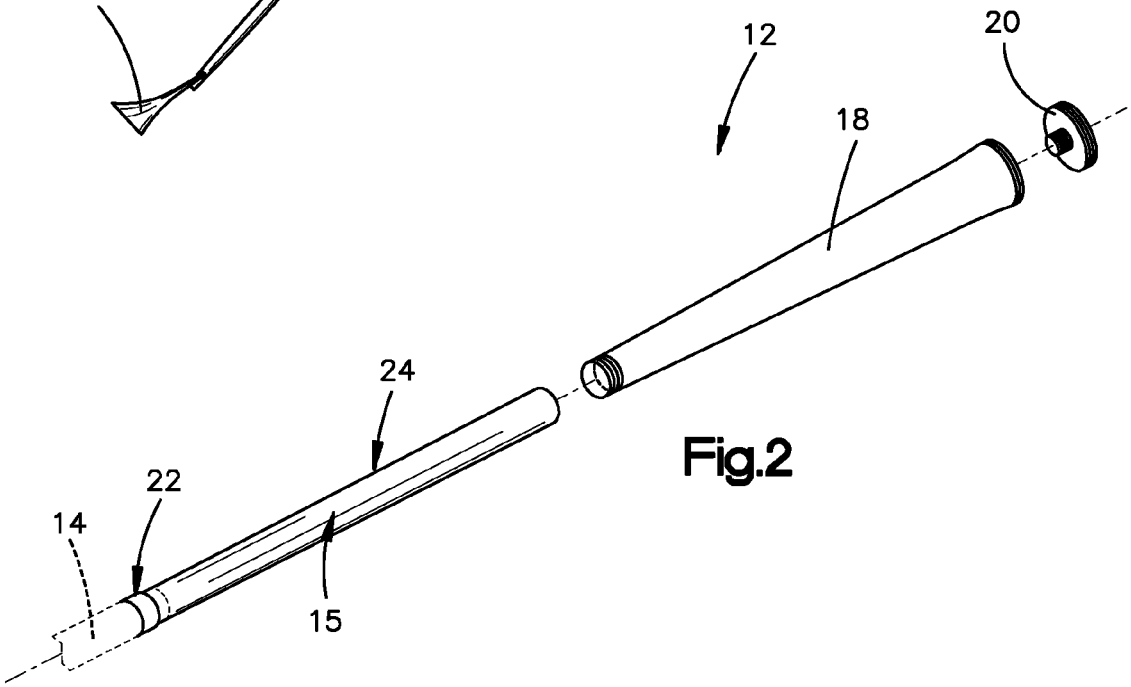
FIG. 2 is an exploded view of the changeable grip according to the present disclosure.

Referring to FIG. 2, there is shown in exploded view a portion of the shaft 14 in dashed line and a changeable grip 12 according to the present disclosure. The changeable grip 12 comprises three parts or elements: a handle sleeve 15, a gripping sleeve 18, and a cap 20 which will be described in greater detail later herein.

Figure 3:
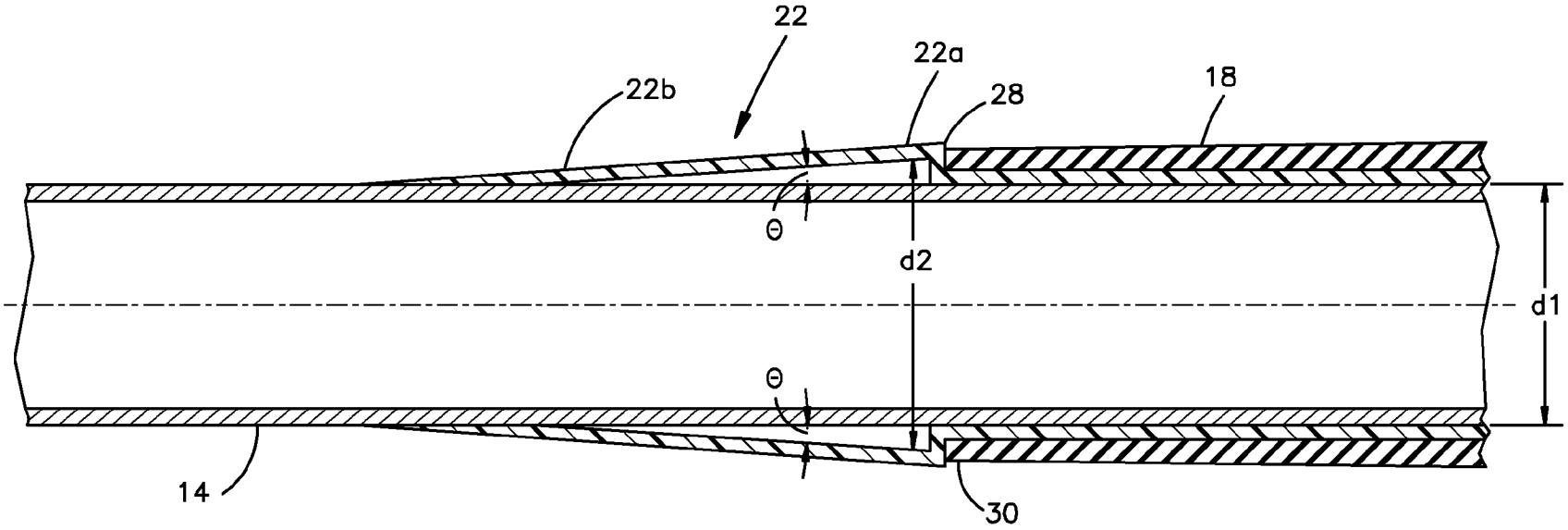
FIG. 3 is an enlarged sectional view of a portion of the golf club shaft and the changeable golf grip according to an embodiment of the present disclosure.

Turning now to FIG. 3, the handle sleeve 15 in one embodiment is a tubular sleeve made with an initial diameter (d1). The term "tubular" as used herein is meant to not only include a cylindrical shape or form, but also oval and other fairly cylindrically-shaped forms like polygons. The elongated tubular handle sleeve 15 has a first and a second end 22, 24. The first end 22 of tubular handle sleeve 15 includes a portion 22*a* at a selected distance measured from the second end 24 of sleeve 15 with a diameter (d2) larger in size than the initial diameter (d1) as seen in the embodiment of FIG. 3. The selected distance fairly corresponds to the desired length of the gripping sleeve 18. This portion 22*a* provides for a sharp bend or reduction in diameter to form a ledge 28. The remaining portion 22*b* may have an angle (θ) to allow the distal end of remaining portion 22*b* to contact a surface of handle 14. The second end 24 of the handle sleeve 15 which is the portion beginning at ledge 28 and extending to a butt end 32 receives the gripping sleeve 18. The initial diameter (d1) of handle sleeve 15 is sized to slide on to handle 14 and be attached thereto in a fixed manner such as by an epoxy or adhesive. Alternatively, it may be attached in a removable manner that will still retain the handle sleeve 15 firmly on the handle 14.

When the gripping sleeve 18 is slid on to handle sleeve 15, the lower end 30 of the sleeve 18 abuts the ledge 28 to hold the lower end 30 of the gripping sleeve 18 in place. The ledge 28 is selectively spaced at a distance from butt end 32 of the handle sleeve 15 to fairly match the desired length of the gripping sleeve 18.

Figure 4:
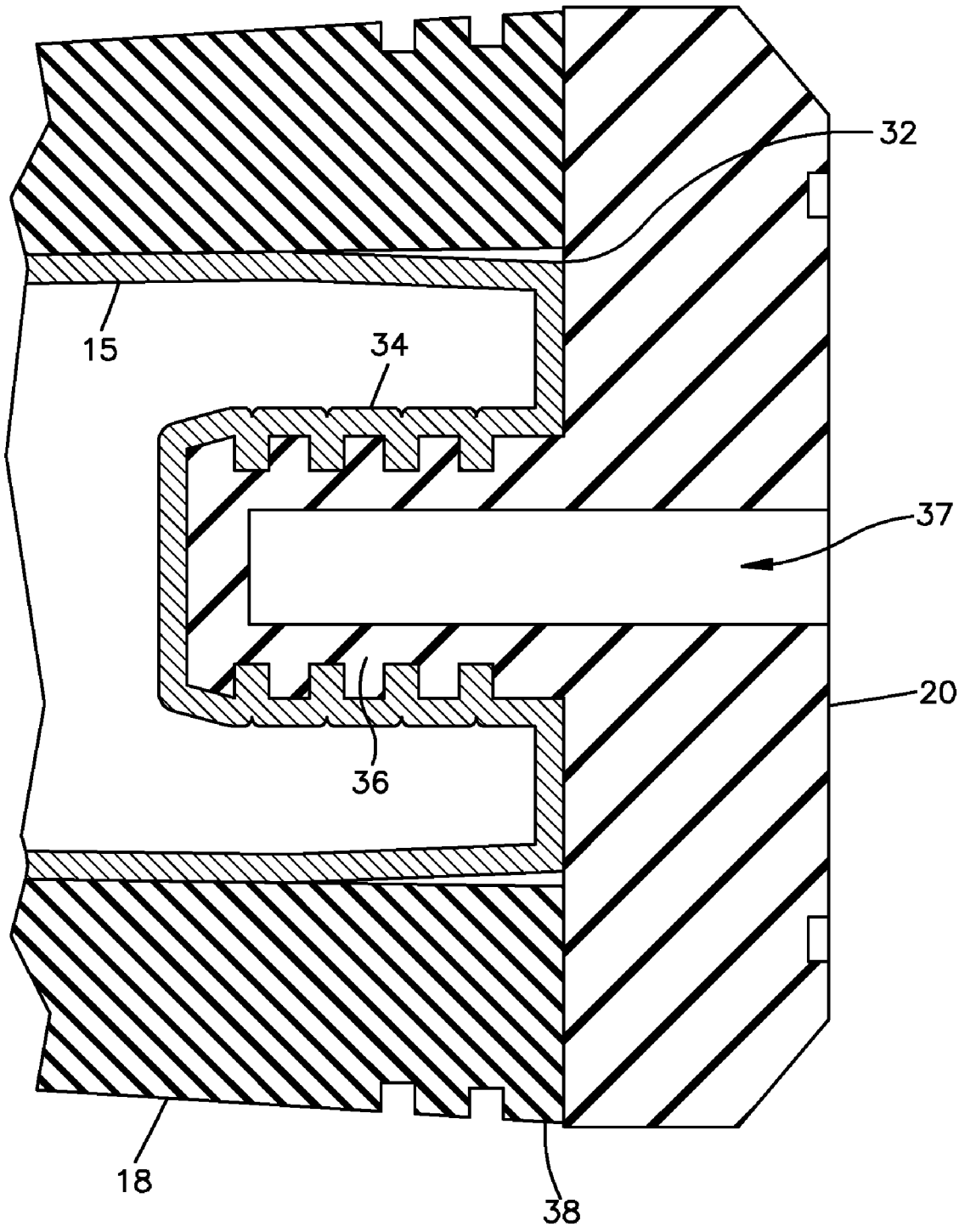
FIG. 4 is an enlarged longitudinal sectional view of the butt end of the shaft and changeable grip according to an embodiment of the present disclosure.

Next referring to FIG. 4, the butt end 32 of handle sleeve 15 has a threaded indentation 34 which may be a threaded aperture or simply an indentation with threads constructed to receive and mesh with a threaded fastener 36. Threaded fastener 36 may be an integral part of cap 20. Alternatively, fastener 36 may be separate from cap 20 simply passing through an opening 37 in cap 20 for securing the cap 20 to the handle sleeve 15. As cap 20 is tightened on to the handle sleeve 15 through fastener 36, the cap 20 can engage an upper end 38 of the gripping sleeve 18 to compress the gripping sleeve 18 against the ledge 28.

Figure 5:
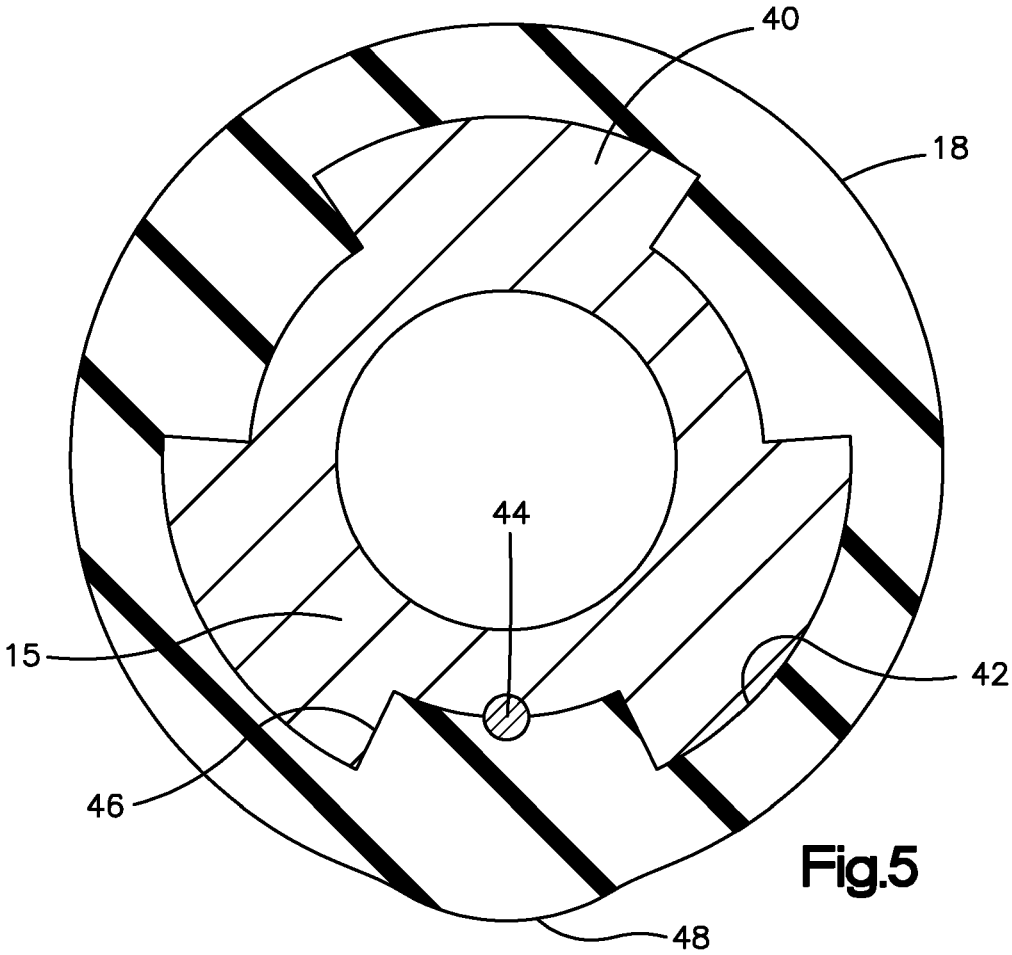
FIG. 5 is a cross-sectional view of changeable grip according to an embodiment of the present disclosure.
Figure 6:
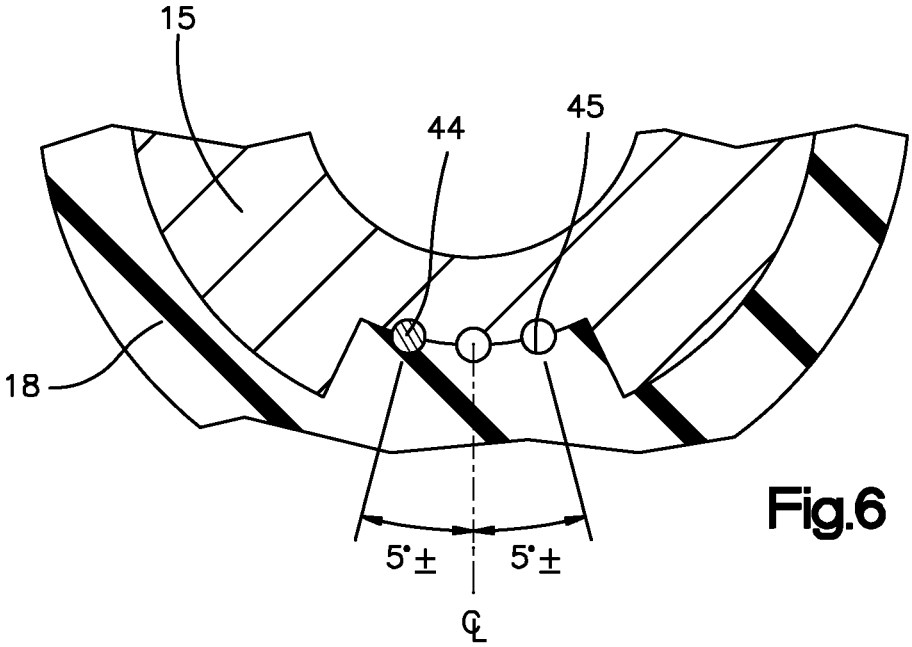
FIG. 6 is a partial cross-sectional view similar to FIG. 5 depicting an alternate embodiment.

As seen in FIGS. 5 and 6, handle sleeve 15 may contain splines or ribs 40 that extend longitudinally along the outer surface of the second end 24 of the handle sleeve 15. The splines 40 may also extend radially in the second end 24 of the handle sleeve 15 in an alternate embodiment. The splines 40 mesh with channels 42 in the gripping sleeve 18 to serve as guides for slidably receiving the gripping sleeve 18 and prevent torsional slippage or rotation of the gripping sleeve 18 during use.

In still another embodiment, an optional elongated rod 44 which may be a metal wire, rod, or an elastomeric line or rod is positioned fairly centrally in a slot 45 on one of the ridges 46 in the gripping sleeve 18 between the splines 40, or in a slot in the spline 40 to form a reminder rib 48 in the gripping sleeve 18 for a golfer. A reminder rib 48 is a device known and used by some golfers for facilitating their hand placement on the grip 12. The United States Golf Association rules require a reminder rib 48 not to be greater than about 0.04 inches or about 1 millimeter. The diameter of the rod 44 should be equal to or less than the 0.04 inches or 1 millimeter in order to comply with the golf rules. In an alternate embodiment with a plurality of slots 45, the location of the reminder rib 48 is adjustable by positioning the rod 44 in one of the slots 45 located either in the spline 40 or the channel 42 as seen in FIG. 6 in a range of approximately five degrees to approximately fifteen degrees on either side of the center position of the ridge 46. FIG. 6 depicts this feature with the rod positioned on either side of the center position at approximately five degrees, but it should be understood that this range can extend as much as approximately fifteen degrees.

The handle sleeve 15 may be constructed from steel, aluminum, titanium or some other metal or metal alloy, fiberglass or graphite, and can be reinforced with carbon or other material fibers if desired. It can be attached to the handle 14 in a variety of ways in either a fixed or removable attachment that retains the handle sleeve 15 firmly on the handle. An adhesive or epoxy compound may be used to attach handle sleeve 15 to the handle 14. This still allows the gripping sleeve 18 and cap 20 to be removed and replaced as desired.

The gripping sleeve 18 and cap 20 may be made from natural or synthetic rubber, an elastomeric material like a rubber compound, a synthetic plastic, thermoplastic material, silicone material, or mixtures thereof, and may contain fibers or cords imbedded therein for a better gripping. Gripping sleeve 18 may contain on its outer surface indicia for decorative purposes, and/or grooves or notches for gripping purposes.

The gripping sleeve 18 can further comprise one or more layers of a rubber, elastomeric, or thermoplastic material, or combinations of such materials. These layers can be arranged to provide varying durometer values. A durometer value or rating is an international standard for the hardness measurement of rubber, plastic and other non-metallic materials. Durometer values and ratings are described in the American Society for Testing and Material specification ASTM D2240. For example in one embodiment, an inner surface of the sleeve 18 may have a hardness value ranging from approximately twenty-five to approximately fifty Shore A hardness. The outer surface or layer of the sleeve 18 can have a durometer value preferably ranging from approximately twenty-five to approximately ninety Shore A. Any combination of durometer values may be used depending upon the user's desire for a surface grip feel with good frictional qualities and tactile feel coupled with a firmer inner section.

The improved changeable grip 12 of the present disclosure allows the user to select and change grips rapidly based on the optimum weight, feel, look, and moisture absorbency for a given application.

While specific embodiments of the disclosure have been shown and described in detail to illustrate the application of the principles of this disclosure, it will be understood that there may be other embodiments based on this without departing from such principles.

I claim:

1. A changeable grip for a shock imparting implement, comprising:

a tubular handle sleeve having an initial diameter, said initial diameter being sized to slidably fit over a handle of a shock imparting implement, said tubular handle sleeve having first and second ends, said first end having a portion at a selected distance with a diameter greater than said initial diameter and forming a ledge, said second end of said tubular handle sleeve terminating in a butt end, said butt end having an internal threaded indentation therein, said ledge being spaced a selected distance from said butt end of said tubular handle sleeve;

a gripping sleeve constructed to slide on said second end of said tubular handle sleeve, a lower end of said gripping sleeve abutting against said ledge;

a cap for covering an upper end of said gripping sleeve; and a fastener for securing said cap and said gripping sleeve to said tubular handle sleeve, said fastener constructed to mesh with said threaded indentation in said butt end of said tubular handle sleeve.

2. A changeable grip according to claim 1 wherein said changeable grip comprises a changeable golf club grip.

3. A changeable grip according to claim 2, wherein said tubular handle sleeve is a material being a member selected from the group consisting of steel, titanium, aluminum, a metal or metal alloy, fiberglass and graphite.

4. A changeable grip according to claim 3, wherein said tubular handle sleeve further comprises at least one spline.

5. A changeable grip according to claim 4, wherein said at least one spline extends longitudinally on said elongated tubular handle sleeve from said ledge towards said butt end.

6. A changeable grip according to claim 5, wherein said gripping sleeve includes at least one channel constructed to mesh with said at least one spline in said tubular handle sleeve.

7. A changeable grip according to claim 6, wherein said at least one channel comprises a plurality of channels in said gripping sleeve.

8. A changeable grip according to claim 7, wherein a ridge on one of said channels in said gripping sleeve includes at least one slot for positioning a rod to form a reminder rib for said grip.

9. A changeable grip according to claim 8, wherein said ridge on one of said channels includes a plurality of slots for positioning said rod from approximately five degrees to approximately fifteen degrees on either said of a center position on said ridge for forming said reminder rib.

10. A changeable grip according to claim 4, wherein said at least one spline comprises a plurality of splines.

11. A changeable grip according to claim 4, wherein said at least one spline comprises a plurality of splines extending radially around said tubular handle sleeve.

12. A changeable grip according to claim 11, wherein gripping sleeve includes a plurality of channels extending radially in said gripping sleeve.

13. A changeable grip, according to claim 1, wherein said gripping sleeve is a material being a member selected from the group consisting of natural rubber, synthetic rubber, an elastomeric material, a thermoplastic material, a silicone material, and mixtures thereof.

14. A changeable grip according to claim 1, wherein said tubular handle sleeve is fixedly attached to a handle of a shock imparting implement.

15. A changeable grip according to claim 14, wherein said tubular handle sleeve is fixedly attached to a golf club shaft and said changeable grip comprises a changeable golf club grip.

16. A changeable grip according to claim 1, wherein said fastener is formed integrally with said cap.

* * * * *